US006444966B2

(12) United States Patent
Mukumoto et al.

(10) Patent No.: US 6,444,966 B2
(45) Date of Patent: Sep. 3, 2002

(54) MICROWAVE OVEN WITH A ROTATIONAL ANTENNA

(75) Inventors: Eiji Mukumoto, Kusatsu; Katsunao Takahashi; Yoshitsugu Kawamura, both of Otsu, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/791,852

(22) Filed: Feb. 26, 2001

(30) Foreign Application Priority Data

Feb. 29, 2000 (JP) ..... 2000-053684

(51) Int. Cl.[7] ..... H05B 6/72
(52) U.S. Cl. ..... 219/749; 219/748
(58) Field of Search ..... 219/749, 748, 219/751, 746

(56) References Cited

U.S. PATENT DOCUMENTS

| | | | | |
|---|---|---|---|---|
| 4,327,267 A | * | 4/1982 | Ikeda et al. | 219/749 |
| 4,412,117 A | * | 10/1983 | Dudley et al. | 219/749 |
| 4,508,946 A | | 4/1985 | Yoshimura et al. | 219/10.55 F |
| 4,568,811 A | | 2/1986 | Yoshimura et al. | 219/10.55 F |
| 4,642,435 A | | 2/1987 | Fitzmayer et al. | 219/10.55 F |
| 4,801,242 A | | 1/1989 | Eunbong | 416/62 |
| 4,833,286 A | | 5/1989 | Ohnishi | 219/10.55 F |
| 5,182,426 A | | 1/1993 | Sklenak et al. | 219/10.55 F |

FOREIGN PATENT DOCUMENTS

| | | | | |
|---|---|---|---|---|
| GB | 1 494 526 | | 12/1977 | |
| GB | 2 329 815 A | | 3/1999 | |
| JP | 64-7496 | * | 1/1989 | 219/749 |
| JP | 4-237992 | * | 8/1992 | 219/749 |
| JP | 2000-164337 | | 6/2000 | |

* cited by examiner

*Primary Examiner*—Philip H. Leung
(74) *Attorney, Agent, or Firm*—Armstrong, Westerman & Hattori, LLP

(57) ABSTRACT

A rotational antenna has a circular portion having a disc-like shape and a cylindrical portion connected to the central portion of the circular portion, and rotates in a direction perpendicular to the sheet with the cylindrical portion serving as an axis. By driving a motor, the motive power is transmitted via a motor shaft and the cylindrical portion to the rotational antenna, thereby rotating the rotational antenna. A bearing serves the function of a spacer between the cylindrical portion and a waveguide. A spacer is attached on an upper surface of the circular portion. The dimension in the direction of height of a spacer is greater than the distance in the direction of height between a bottom plate and a portion in the vicinity of the central portion of the rotational antenna. Thus, the rotational antenna deflects from its central portion toward its outer edge portion, and is fixed with respect to the up-down direction by spacers and the bearing.

5 Claims, 8 Drawing Sheets

MICROWAVE OVEN WITH A ROTATIONAL ANTENNA

BACKGROUND OF THE INVENTION

1. Field of the Invention

The present invention relates to a microwave oven, and more specifically, to a microwave oven of a type having an antenna that rotates to diffuse the microwaves.

2. Description of the Background Art

Some of the conventional microwave ovens are provided with rotatable antennas (hereinafter referred to as a "rotational antenna") for diffusing and supplying the microwaves oscillated by a magnetron in a heating chamber. FIG. 9 shows a portion of a conventional microwave oven to which a rotational antenna is mounted. The microwave oven shown in FIG. 9 is of a type having the rotational antenna attached below the heating chamber. Moreover, FIG. 9 also shows a partial cross section of the microwave oven.

As shown in FIG. 9, a rotational antenna 90 is attached to a portion of a main body frame 98 of the microwave oven below a bottom surface 99 of the heating chamber.

Specifically, an antenna bearing 91 is first fitted to an antenna shaft 93 from above antenna shaft 93, and rotational antenna 90 is then fitted to the upper end of antenna shaft 93 and is fixed thereto with a nut 94. Antenna bearing 91 is fixed with a plurality of pins 92 along its periphery portion to main body frame 98. In addition, when antenna bearing 91 is fixed to main body frame 98, the lower portion of antenna shaft 93 is fitted to a motor shaft 95.

Upon fixing antenna bearing 91 to main body frame 98, pins 92 are inserted into main body frame 98. This insertion of pins 92, however, is a complicated task. As shown in FIG. 9, since rotational antenna 90 is located above antenna bearing 91, the insertion has to be done within the relatively narrow space between main body frame 98 and rotational antenna 90. In other words, a conventional microwave oven, when provided with a rotational antenna, disadvantageously required a complicated operation in mounting the rotational antenna. It is expected that the effort to facilitate the mounting operation would complicate the construction of the microwave oven itself.

Moreover, it is greatly desired that a microwave oven be formed such that it may supply microwaves in a manner that avoids uneven heating of the object to be heated. In a microwave oven, uneven heating of the object to be heated can, for instance, be eliminated by changing the radiation modes of the microwaves. It is expected, however, that the changing of the radiation modes of the microwaves would complicate the structure of a microwave oven.

SUMMARY OF THE INVENTION

The present invention was construed in view of such present conditions, and its object is to provide a microwave oven that can be easily formed while offering various advantages.

According to one aspect of the present invention, the microwave oven includes a heating chamber for accommodating a food product, a magnetron for supplying microwaves, a rotational antenna formed to allow rotation for stirring the microwaves oscillated by the magnetron, a motor for rotating the rotational antenna, and a motor shaft that serves as a rotational shaft for the motor, and is characterized in that the rotational antenna has a planar portion that extends on a plane intersecting the rotational shaft of the rotational antenna and a cylindrical portion having one end connected to the planar portion and the other end connected to the motor shaft and extending in the direction intersecting the planar portion.

According to the present invention, the rotational antenna is directly connected to the rotational shaft the motor.

In this manner, no such complicated operation as pinning down to fix the rotational antenna as described with reference to FIG. 9 is required when mounting rotational antenna 45. Thus, a microwave oven that is relatively easily formed and that facilitates the mounting of the rotational antenna can be provided.

In the microwave oven according to the present invention, the rotational antenna is provided in its planar portion with a first spacer for filling the gap between the rotational antenna and one of the wall surfaces inside the microwave oven, and the microwave oven preferably further includes a second spacer for filling the gap between the other end of the cylindrical portion and one of the wall surfaces inside the microwave oven.

In this manner, the rotational antenna is positioned between prescribed wall surfaces inside the microwave oven by the first spacer and the second spacer.

Moreover, in the microwave oven according to the present invention, the planar portion and the cylindrical portion of the rotational antenna are preferably formed integrally.

In this manner, the production of the rotational antenna can be facilitated since the operation of connecting the planar portion and the cylindrical portion is unnecessary.

According to another aspect of the present invention, the microwave oven includes a heating chamber for accommodating a food product, a magnetron for supplying microwaves, a rotational antenna formed to allow rotation for stirring the microwaves oscillated by the magnetron, a motor for rotating the rotational antenna, an antenna shaft serving as a rotational shaft for the rotational antenna, and a motor shaft that serves as a rotational shaft for the motor, and is characterized in that the rotational antenna is connected to one end of the antenna shaft, and the other end of the antenna shaft is fitted to the motor shaft such that the antenna shaft and the motor shaft overlap by a prescribed length in the direction intersecting the direction of rotation of the rotational antenna, and that the rotational antenna is provided with a spacer by which the gap between the rotational antenna and one of the wall surfaces inside the microwave oven is kept smaller than a prescribed length in the direction intersecting the direction of rotation of the rotational antenna.

According to the present invention, the rotational antenna, when rotated, is moved toward the direction intersecting the direction of rotation by a Coriolis force. When the force is of a magnitude that only moves the rotational antenna by a distance smaller than the prescribed length, the rotational antenna remains fitted to the motor. Moreover, even when the force exceeds the force of a magnitude required to move the rotational antenna by the prescribed length, the spacer collides with a wall surface inside the microwave oven so that the rotational antenna remains fitted to the motor.

In this manner, no such complicated operation for fixing the rotational antenna in advance as described with reference to FIG. 9 is required when positioning the rotational antenna. Thus, a microwave oven that is relatively easily formed and that facilitates the mounting of the rotational antenna can be provided.

In addition, in the microwave oven according to the present invention, one of the wall surfaces inside the microwave oven is a bottom surface of the heating chamber.

According to a still further aspect of the present invention, the microwave oven includes a heating chamber for accommodating a food product, a magnetron for supplying microwaves, a rotational antenna formed to allow rotation for stirring the microwaves oscillated by the magnetron, an antenna shaft being fixed to the rotational antenna and serving as a rotational shaft for the rotational antenna, and further an antenna bearing for supporting the antenna shaft, and is characterized in that the antenna bearing supports the antenna shaft such that the height of the antenna shaft changes according to the rotational angle of the rotational antenna.

According to the present invention, the rotational antenna is fixed to the antenna shaft so that the height can be changed through rotation.

Therefore, the rotational antenna can change its height simply by rotating. In addition, by changing the height of the rotational antenna, the radiation modes of the microwaves can be changed. Thus, a microwave oven that is relatively easily formed and that allows changing of the radiation modes of microwaves can be provided.

In addition, in the microwave oven according to the present invention, it is preferred that the antenna shaft is provided with a protruded portion that rotates along with the rotation of the rotational antenna, and that the antenna bearing, with the protruded portion placed on its upper end, supports the antenna shaft and presents height variation at its upper end with which the protruded portion makes contact when rotating.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

The microwave oven having a rotatable antenna according to the first embodiment of the present invention will be described below with reference to the drawings.

Figure 1:
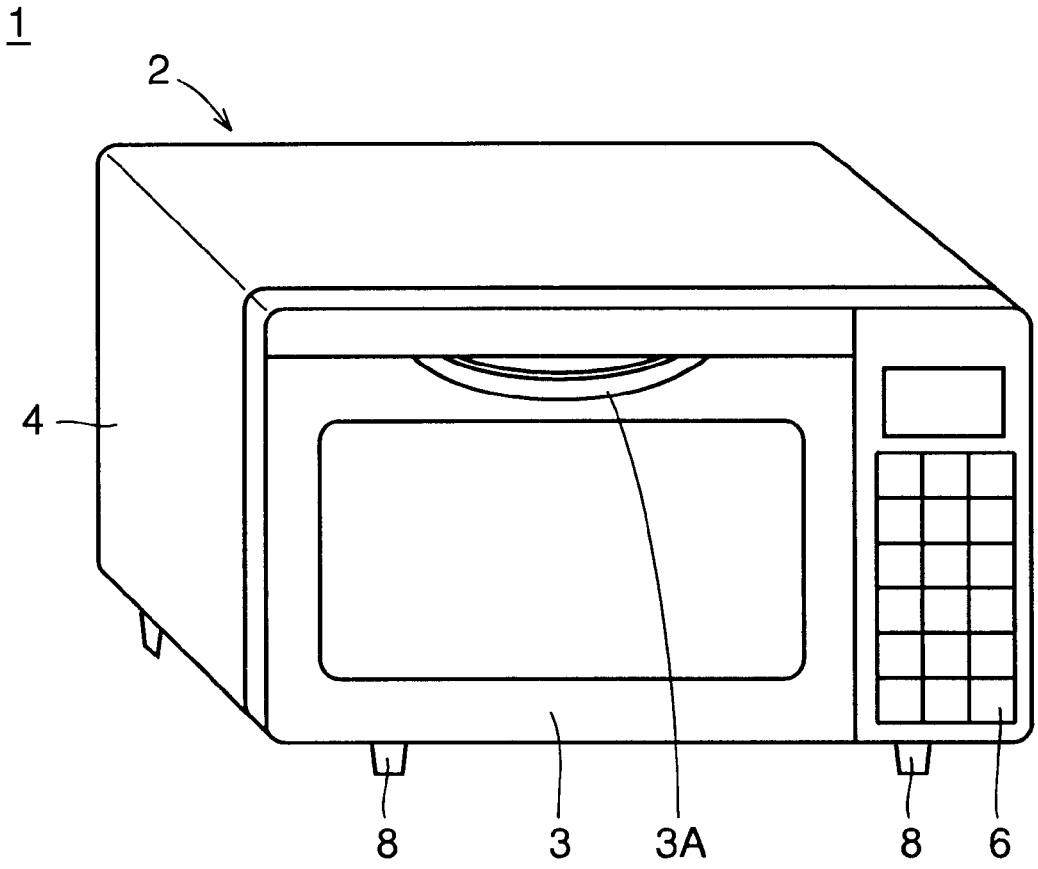
FIG. 1 is a perspective view of a microwave oven of a first embodiment of the present invention.

As shown in FIG. 1, a microwave oven 1 is mainly formed of a main body 2 and a door 3. Main body 2 is covered by exterior of cabinet 4 along its outer contour. In addition, on the front of main body 2, an operating panel 6 is provided for the user to input a variety of information into microwave oven 1. Main body 2 is supported by a plurality of feet 8.

Figure 2:
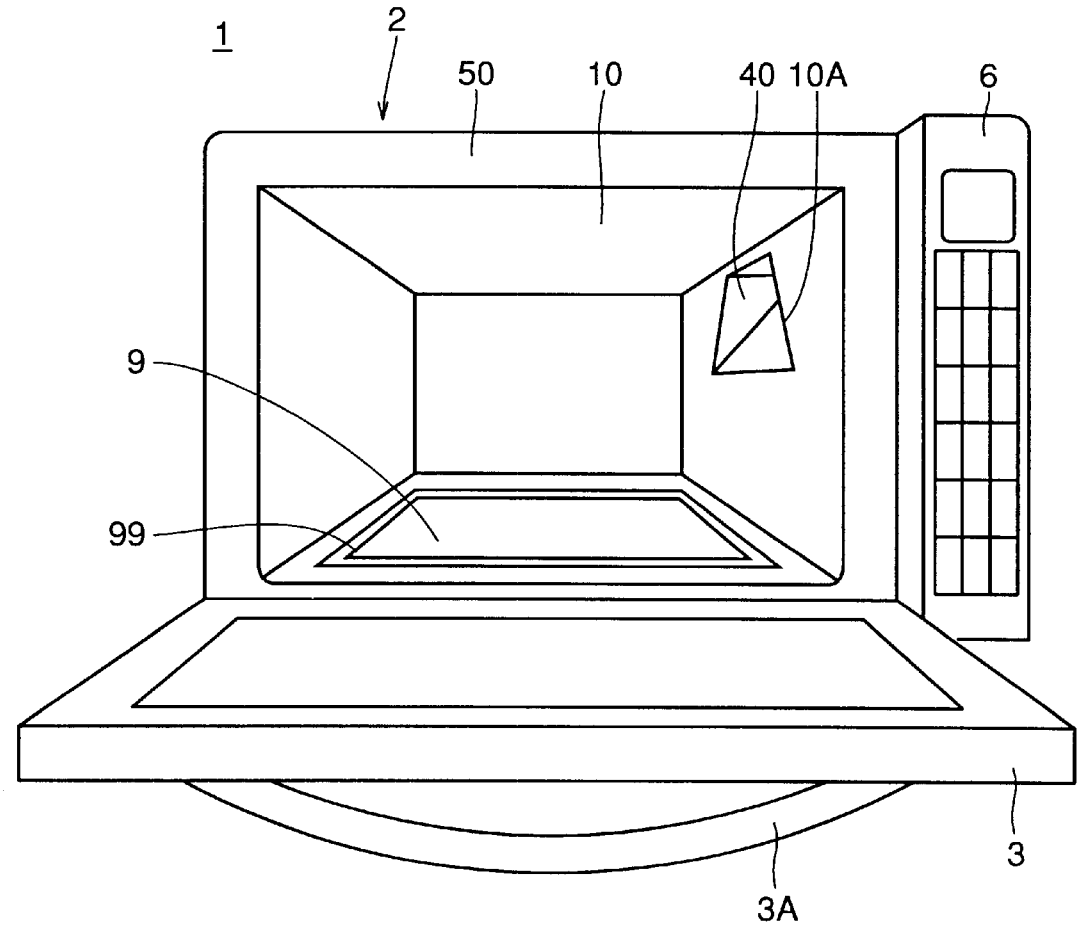
FIG. 2 is a front view of the microwave oven of FIG. 1.

Door 3 is configured such that it can open or shut with its lower end serving as an axis. A handle 3A is provided at the upper portion of door 3. FIG. 2 is a front view of microwave oven 1 with door 3 opened.

A main body frame (hereinafter described as main body frame 5) is provided inside exterior of cabinet 4. Inside main body frame 5, a heating chamber 10 is provided. Moreover, a front plate 50 is provided at the front of main body frame 5. A hole 10A is formed in the upper right side portion of heating chamber 10. To hole 10A, a detection path 40 is connected from outside heating chamber 10. A bottom plate 9 is provided at the bottom portion of heating chamber 10. A food product can be placed on bottom plate 9. Moreover, silicon 99 is provided to seal the perimeter of bottom plate 9.

Figure 3:
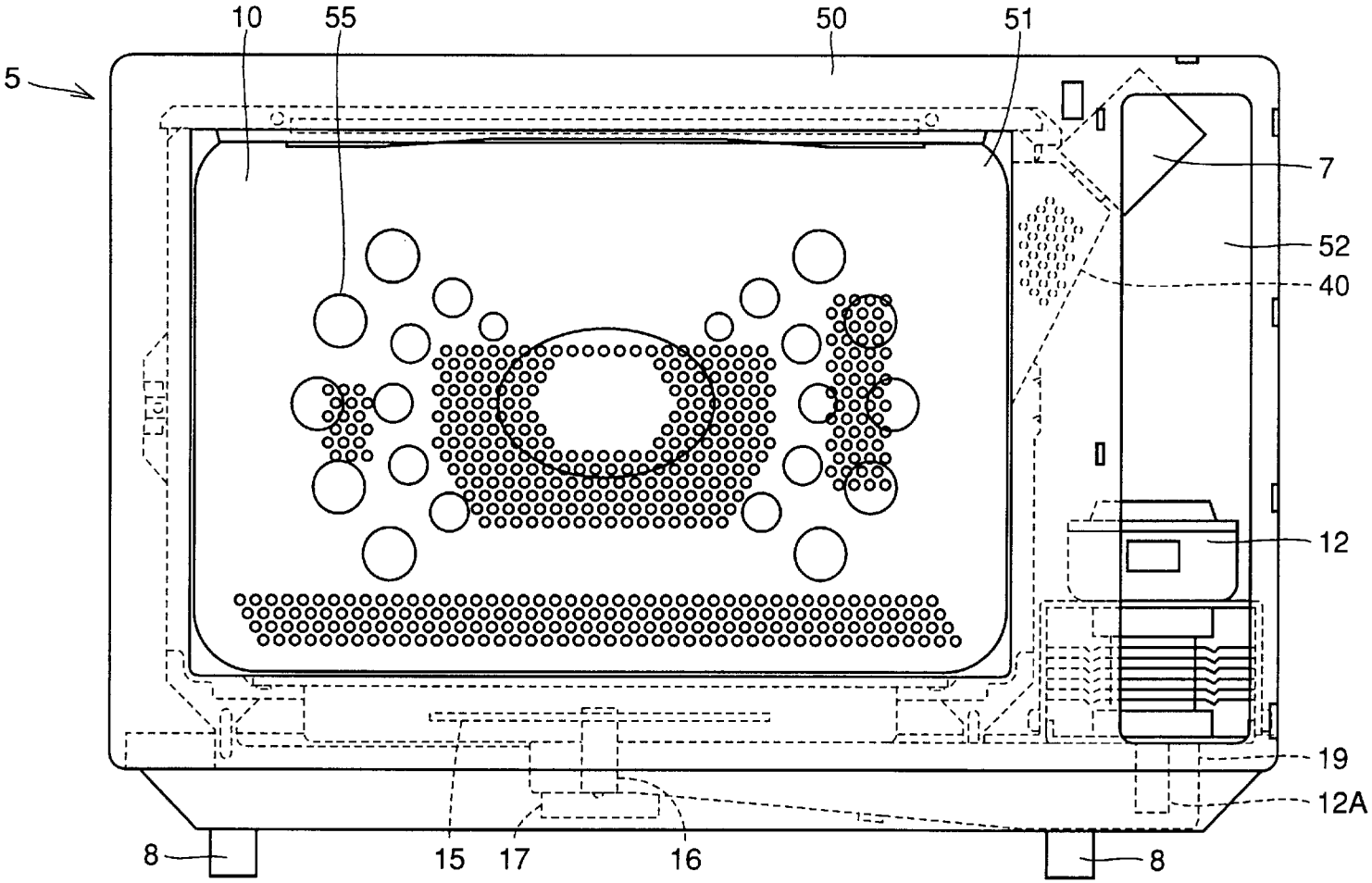
FIG. 3 is a front view of the main body frame portion of the microwave oven of FIG. 1.

FIG. 3 is a front view of microwave oven 1 with its exterior of cabinet 4 removed. An opening 51 for opening up heating chamber 10 and a hole 52 for fitting operating panel 6 therein are formed in front plate 50.

In addition, a magnetron 12 is provided on main body frame 5 to the right of heating chamber 10. A waveguide 19 is provided below heating chamber 10 and magnetron 12. Magnetron 12 is connected to one end of waveguide 19. The other end of waveguide 19 is connected to a bottom surface of main body frame 5, i.e. to the lower portion of heating chamber 10. Magnetron 12 has a magnetron antenna 12A located inside waveguide 19.

A rotational antenna 15 is provided below heating chamber 10. Rotational antenna 15 has a disc-like shape with a plurality of holes formed thereto. FIG. 3 shows the side view. A motor 17 is provided below rotational antenna 15 below waveguide 19. Motor 17 and rotational antenna 15 are connected via a shaft 16 that penetrates waveguide 19. Shaft 16 is formed of a plurality of members, as described below.

By driving motor 17, the motive power is transmitted via shaft 16 and rotational antenna 15 is rotated. In microwave oven 1, the microwaves oscillated by magnetron 12 are supplied via waveguide 19 into heating chamber 10 such that the microwaves are diffused by rotational antenna 15. Moreover, a plurality of protruded portions 55 are formed on the rear surface of heating chamber 10 in order further to diffuse the microwaves within heating chamber 10.

One end of detection path 40 is connected to hole 10A in heating chamber 10. An infrared ray sensor 7 is attached to the other end of detection path 40. Infrared ray sensor 7 detects the infrared rays emitted by a food product within heating chamber 10 via detection path 40, thereby detecting the temperature of the food product. In addition, a plurality of small holes are formed on a side surface of detection path 40 so as to keep the lens portion of infrared ray sensor 7 from becoming fogged by the vapor from the food product.

Figure 4:
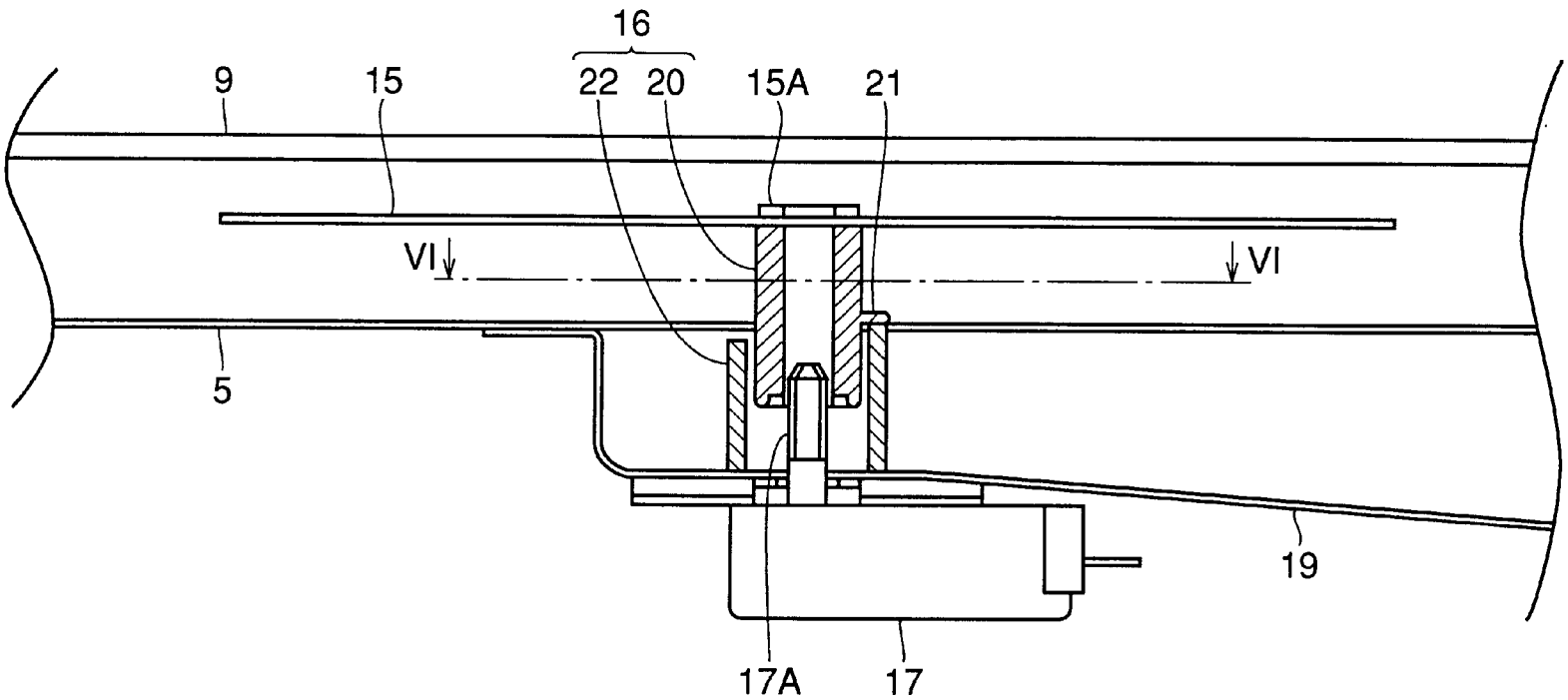
FIG. 4 is an enlarged view of a portion near a rotational antenna of the microwave oven shown in FIG. 3.

Now, the arrangement of shaft 16 will be described. As shown in FIG. 4, shaft 16 is formed by an antenna shaft 20 and a bearing 22. FIG. 4 shows a vertical cross section of antenna shaft 20 and bearing 22. Antenna shaft 20 has a protruded portion 21 on its side surface. Protruded portion 21 is in contact with the upper end of bearing 22. Bearing 22 supports protruded portion 21 at its upper end, thereby supporting antenna shaft 20.

Antenna shaft 20 has its upper end connected to the center of gravity of the disc of rotational antenna 15. Rotational antenna 15 is fixed to antenna shaft 20 by securing the portion connecting rotational antenna 15 and antenna shaft 20 using a screw 15A. Moreover, antenna shaft 20 has its lower end connected to a motor shaft 17A. Motor shaft 17A is a member that rotates when driven by motor 17. Thus, by driving motor 17, rotational antenna 15 is rotated via motor shaft 17A and antenna shaft 20. Rotational antenna 15 rotates on a plane perpendicular to the sheet of FIG. 4.

Now, the structure of bearing 22 and its surrounding components will be described with reference to FIGS. 5A, 5B, and 6.

Figure 6:
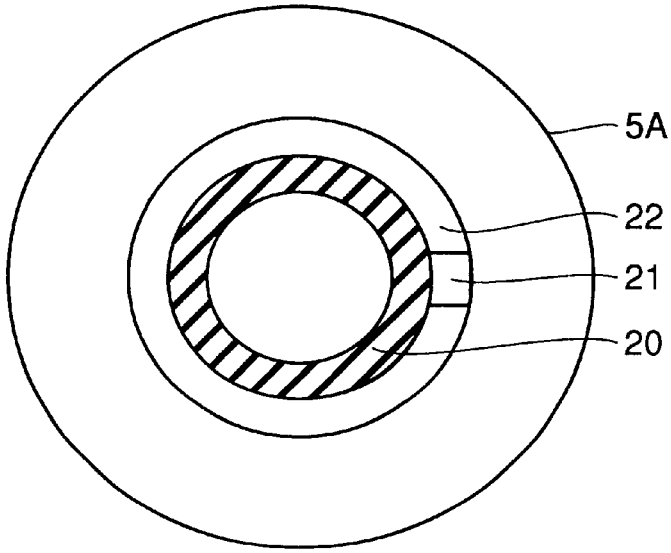
FIG. 6 is a cross sectional view taken along the line VI—VI in FIG. 4.

First, as shown in FIG. 6, bearing 22 and antenna shaft 20 are located inside a hole 5A formed in main body frame 5. Protruded portion 21 of antenna shaft 20 is located on the upper end of bearing 22.

Figure 5A:
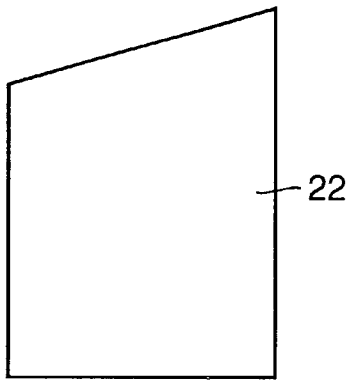
FIG. 5A is a side view of a bearing shown in FIG. 4.
Figure 5B:
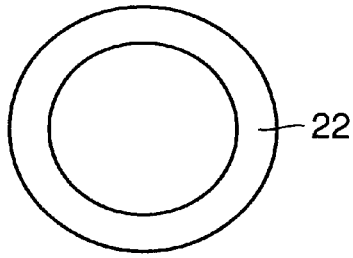
FIG. 5B is a plane view of a bearing shown in FIG. 4.

As shown in FIGS. 5A and 5B, bearing 22 has a cylindrical shape with a slanted upper end (see particularly FIG. 5A). Thus, when protruded portion 21 rotates according to the rotation of rotational antenna 15, the height of protruded portion 21 changes. With the change of height of protruded portion 21, the height of antenna shaft 20 and the height of rotational antenna 15 also change. Consequently, by driving motor 17, rotational antenna 15 is made to rotate while its height changes.

Thus, in microwave oven 1, microwaves can be supplied to heating chamber 10 in a greater number of modes while rotational antenna 15 rotates with its height changing.

According to this embodiment, an antenna bearing is configured such that an antenna shaft is supported by bearing 22 so that the height of the antenna shaft changes according to the rotational angle of a rotational antenna.

The manner in which the height of the antenna shaft is changed according to the rotation of the rotational antenna is not limited to the manner described in this embodiment.

According to this embodiment, however, the height of antenna shaft 20 is changed as described above by devising a special shape for bearing 22. Specifically, bearing 22 changes the height of antenna shaft 20 by virtue of the fact that bearing 22 supports antenna shaft 20 by a protruded portion, and that bearing 22 has a slant, in the direction of rotation of antenna shaft 20, at the upper end where the protruded portion is to be supported. Microwave oven 1 being configured thus, the height of the antenna shaft can be changed more readily according to the rotation of the rotational antenna.

Second Embodiment

Now, a microwave oven according to the second embodiment of the present invention will be described.

The microwave oven according to this embodiment is microwave oven 1 described as the first embodiment with the structures of rotational antenna 15 and its surrounding components modified. The description of the same or corresponding members will not be repeated here.

Figure 7:
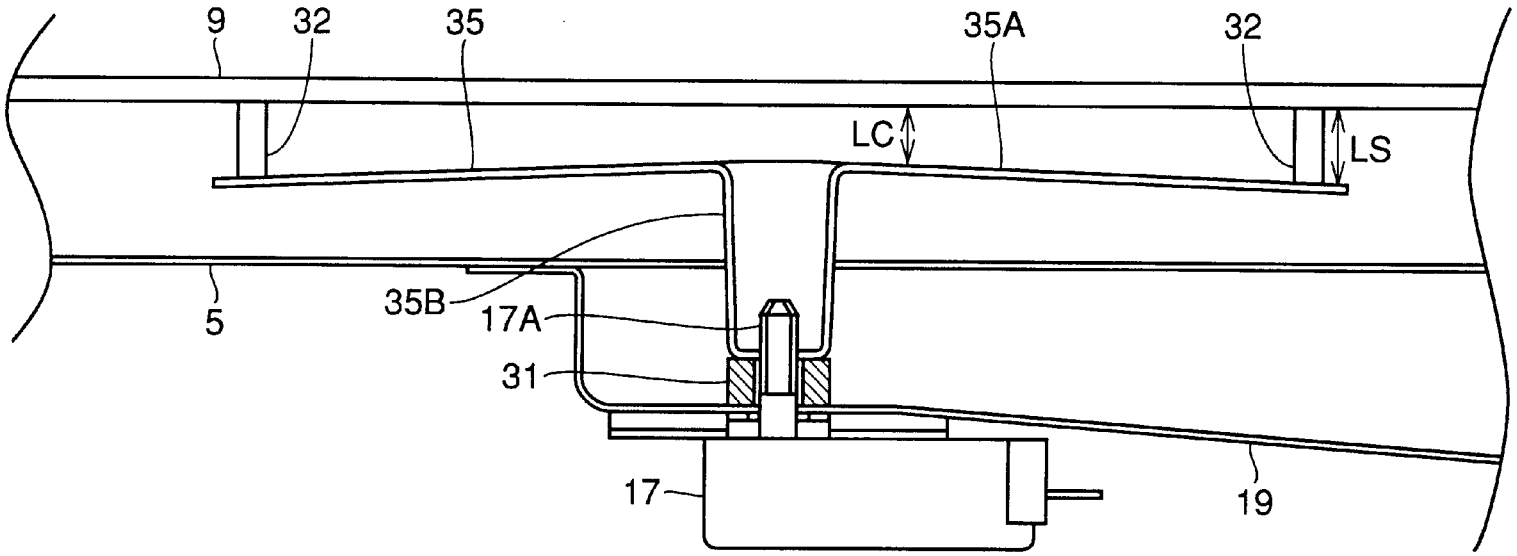
FIG. 7 is a diagram showing the vicinity of a rotational antenna of a microwave oven of a second embodiment of the present invention.

As shown in FIG. 7, rotational antenna 35 generally has the shape of a pot lid turned upside down. In other words, rotational antenna 35 has a circular portion 35A having a disc-like shape and a cylindrical portion 35B connected to the central portion of circular portion 35A. Thus, rotational antenna 35 rotates in a direction perpendicular to the sheet of FIG. 7 with cylindrical portion 35B serving as an axis. Rotational antenna 35 may be formed, for instance, by deforming a disc-like plate by pulling out its central portion. Therefore, in rotational antenna 35, circular portion 35A and cylindrical portion 35B can be formed integrally.

The upper end of cylindrical portion 35B is connected to circular portion 35A. On the other hand, the lower end of cylindrical portion 35B has a bottom which has a circular hole formed thereto. A motor shaft 17A is fitted into this circular hole. In addition, the circular hole has a shape matching the cross sectional shape of motor shaft 17A. Thus, by driving motor 17, the motive power is transmitted via motor shaft 17A and cylindrical portion 35B so as to rotate rotational antenna 35.

The lower end of cylindrical portion 35B is located inside a waveguide 19. A bearing 31 is provided between the bottom of waveguide 19 and the lower end of cylindrical portion 35B. The upper end of bearing 31 is in contact with cylindrical portion 35B. Moreover, the lower end of bearing 31 is in contact with waveguide 19. Bearing 31 serves the function of a spacer between cylindrical portion 35B and waveguide 19.

In addition, a spacer 32 is attached on an upper surface of circular portion 35A. More specifically, cylindrical spacers 32 having a diameter of about 5 mm are attached to circular portion 35A along its outer edge portion in a plurality of locations. The upper end of a spacer 32 makes contact with a bottom plate 9. The dimension in the direction of height (LS) of spacer 32 is greater than the distance (LC) in the direction of height between bottom plate 9 and a portion in the vicinity of the central portion of rotational antenna 35. Thus, rotational antenna 35 deflects from its central portion toward its outer edge portion.

Rotational antenna 35 rotates with spacers 32 and bottom plate 9 being in contact with one another. Thus, it is preferred that spacer 32 is formed of a highly wear-resistant material such as Teflon.

In this embodiment described above, rotational antenna 35 is fixed by bearing 31 and spacers 32 with respect to the up-down direction in a prescribed location within the microwave oven. In other words, the microwave oven according to this embodiment does not require a complicated operation such as screwing when fixing rotational antenna 35.

Furthermore, rotational antenna 35 can be fixed by bearing 31 and spacers 32 if the dimension in the direction of height (LS) of spacer 32 is the same as the distance (LC) in the direction of height between bottom plate 9 and a portion in the vicinity of the central portion of rotational antenna 35. Rotational antenna 35, however, can be fixed with more stability by making LS longer than LC as described in this embodiment.

Third Embodiment

Now, a microwave oven according to the third embodiment of the present invention will be described.

The microwave oven according to this embodiment is microwave oven 1 described as the first embodiment with the structures of rotational antenna 15 and its surrounding components modified. The description of the same or corresponding members will not be repeated here.

Figure 8:
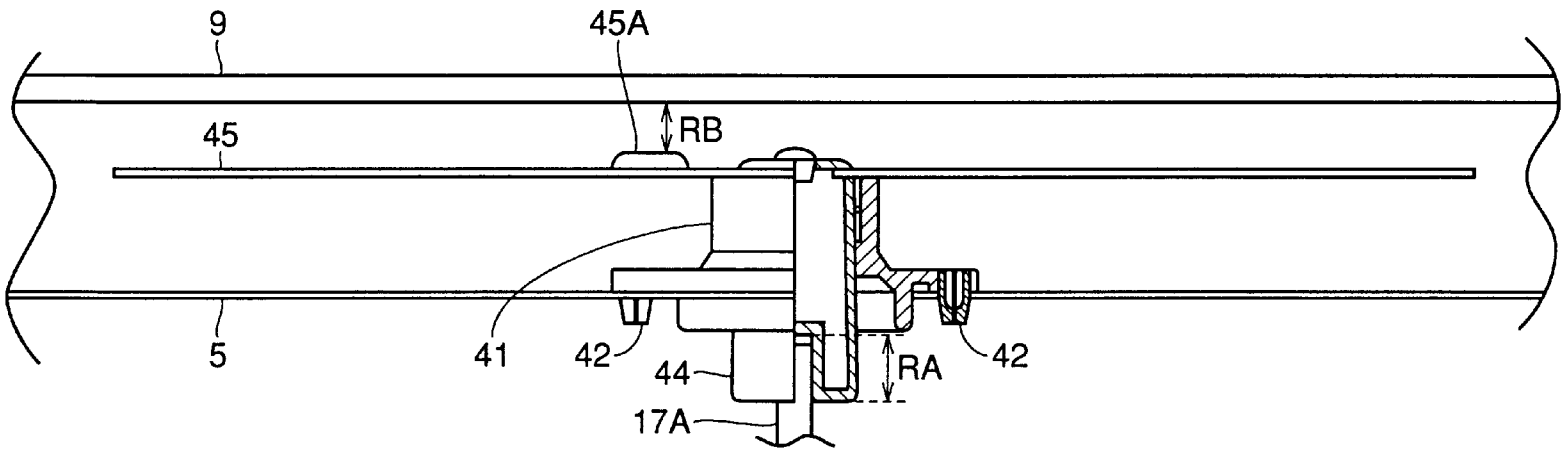
FIG. 8 is a diagram showing the vicinity of a rotational antenna of a microwave oven of a third embodiment of the present invention.

As shown in FIG. 8, rotational antenna 45 has a disc-like shape with a plurality of holes formed thereto. An antenna shaft 44 is connected to the central portion of rotational antenna 45. Antenna shaft 44 has its upper end fitted into the central portion of rotational antenna 45 and folded over toward rotational antenna 45. In this manner, rotational antenna 45 is fixed to antenna shaft 44. Thus, rotational antenna 45 rotates in the direction perpendicular to the sheet of FIG. 8 with antenna shaft 44 serving as an axis.

Bearing 41 is provided outside antenna shaft 44. Bearing 41 has a cylindrical shape, and accommodates antenna shaft 44 inside. Bearing 41 has a plurality of protrusions 42 attached thereto, and is fixed to main body frame 5 by inserting protrusions 42 into holes formed in prescribed locations of main body frame 5.

Figure 9:
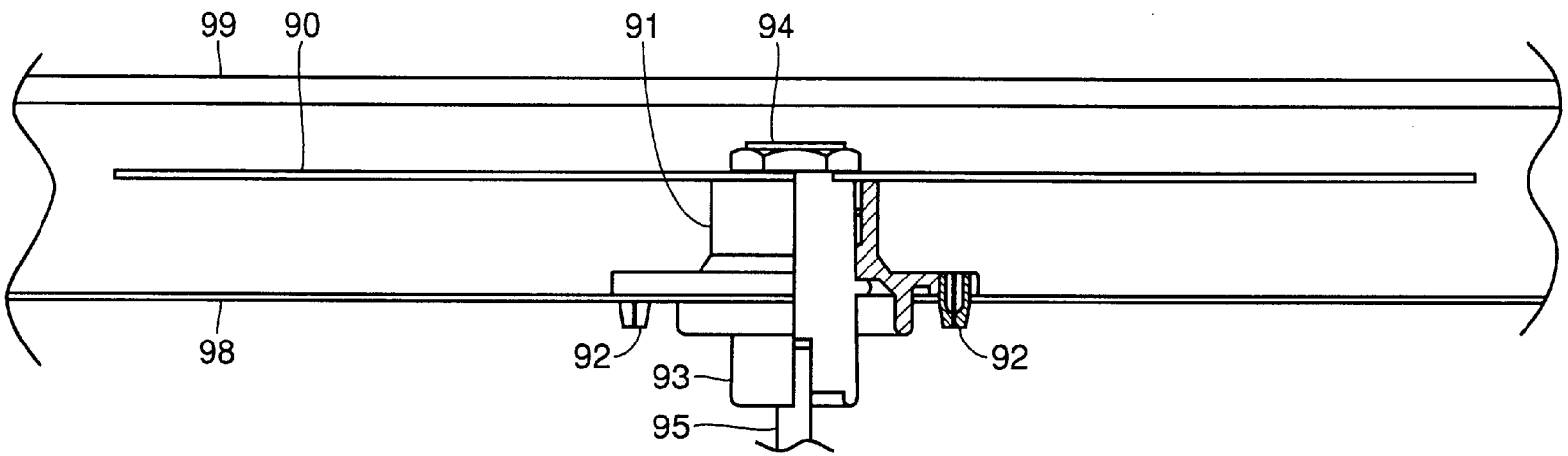
FIG. 9 PRIOR ART
FIG. 9 is a diagram showing the vicinity of a rotational antenna of a conventional microwave oven.

In the microwave oven according to this embodiment, bearing 41 is fixed to main body frame 5. On the other hand, rotational antenna 45 is fixed to antenna shaft 44, and thereafter, antenna shaft 44 is fitted into bearing 41 and motor shaft 17A, and then, bottom plate 9 is placed from above rotational antenna 45. In this way, no such complicated operation as screwing described with reference to FIG. 9 is required when mounting rotational antenna 45.

Moreover, antenna shaft 44 is fitted to motor shaft 17A such that they overlap by a distance of RA in the height direction. In addition, a protruded portion 45A is formed on the upper surface of rotational antenna 45. Protruded portion 45A may be formed, for example, by locally pressing against rotational antenna 45 from one side to form a protrusion. The distance in the height direction between an uppermost portion of protruded portion 45A and bottom plate 9 is RB. In this embodiment, RA>RB. Thus, even when rotational antenna 45 is rotated, antenna shaft 44 does not come off from motor shaft 17A for the following reason.

When rotational antenna 45 rotates in the direction perpendicular to the sheet of FIG. 8, a force is exerted on rotational antenna 45 that makes rotational antenna 45 to move in the upward direction of the sheet as a Coriolis force. When rotational antenna 45 tries to move upward by more than the distance of RB, however, bottom plate 9 pushes it back downward. Since antenna shaft 44 and motor shaft 17A overlap by the distance of RA, antenna shaft 44 does not come off from motor shaft 17A even when an upward shift of the length smaller than RA takes place.

In this embodiment, protruded portion 45A forms a spacer by which the gap between the rotational antenna and one of the wall surfaces inside the microwave oven is kept smaller than a prescribed length in the direction intersecting the direction of rotation of the rotational antenna.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven, comprising:

a heating chamber for accommodating a food product;

a magnetron for supplying microwaves;

a rotational antenna formed to allow rotation for stirring the microwaves oscillated by said magnetron;

a motor for rotating said rotational antenna;

an antenna shaft serving as a rotational shaft for said rotational antenna; and a motor shaft that serves as a rotational shaft for said motor, wherein said rotational antenna is connected to one end of said antenna shaft, and other end of said antenna shaft is fitted to said motor shaft such that said antenna shaft and said motor shaft overlap by a prescribed length in a direction intersecting a direction of rotation of said rotational antenna, and said rotational antenna is arranged such that a gap between said rotational antenna and one of wall surfaces inside said microwave oven is kept smaller than said prescribed length in a direction intersecting a direction of rotation of said rotational antenna.

2. The microwave oven according to claim 1, wherein one of wall surfaces inside said microwave oven is a bottom surface of said heating chamber.

3. A microwave oven as defined in claim 1, wherein said rotational antenna includes a planar portion that extends on a plane intersecting the rotational shaft of said rotational antenna, and a cylindrical portion having one end connected to said planar portion and other end connected to said motor shaft and extending in a direction intersecting said planar portion.

4. The microwave oven according to claim 3, wherein said rotational antenna is provided in said planar portion with a first spacer for filling a gap between said rotational antenna and one of wall surfaces inside said microwave oven, and said microwave oven further comprising:

a second spacer for filling a gap between the other end of said cylindrical portion and one of wall surfaces inside said microwave oven.

5. The microwave oven according to claim 3, wherein said planar portion and said cylindrical portion of said rotational antenna are formed integrally.

* * * * *